US007707819B2

(12) United States Patent
Viecelli et al.

(10) Patent No.: US 7,707,819 B2
(45) Date of Patent: May 4, 2010

(54) EXPLOSIVELY DRIVEN LOW-DENSITY FOAMS AND POWDERS

(75) Inventors: James A. Viecelli, Orinda, CA (US); Lowell L. Wood, Simi Valley, CA (US); Muriel Y. Ishikawa, Livermore, CA (US); John H. Nuckolls, Danville, CA (US); Phillip F. Pagoria, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 636 days.

(21) Appl. No.: 10/947,815

(22) Filed: Sep. 22, 2004

(65) Prior Publication Data

US 2005/0230018 A1 Oct. 20, 2005

Related U.S. Application Data

(63) Continuation-in-part of application No. 10/427,612, filed on Apr. 30, 2003, now abandoned, which is a continuation-in-part of application No. 10/293,659, filed on Nov. 12, 2002, now Pat. No. 6,875,294.

(51) Int. Cl.
*C06D 5/06* (2006.01)
*C06B 43/00* (2006.01)
*C06B 25/34* (2006.01)

(52) U.S. Cl. ..... 60/205; 149/22; 149/92

(58) Field of Classification Search ..... 149/17, 149/22, 92; 264/3.1, 3.4; 102/314, 318, 102/322; 60/205

See application file for complete search history.

(56) References Cited

U.S. PATENT DOCUMENTS

| | | | | |
|---|---|---|---|---|
| 3,570,364 | A * | 3/1971 | Thibodaux | 86/1.1 |
| 3,653,792 | A * | 4/1972 | Garrett | 425/1 |
| 3,908,364 | A * | 9/1975 | LeFebvre et al. | 60/252 |
| 3,969,167 | A * | 7/1976 | Johannes | 149/38 |
| 4,151,022 | A * | 4/1979 | Donaghue et al. | 149/19.4 |
| H000778 | H * | 5/1990 | Carlton et al. | 149/19.2 |
| 5,339,624 | A * | 8/1994 | Calsson et al. | 60/207 |
| 5,386,777 | A * | 2/1995 | Lou et al. | 102/291 |
| 6,461,550 | B1 * | 10/2002 | Whinnery, Jr. | 264/45.4 |
| 6,679,176 | B1 * | 1/2004 | Zavitsanos et al. | 102/364 |

* cited by examiner

OTHER PUBLICATIONS

Hoffman et al. undated. RX-08-HD, A low-viscosity injection-moldable explosive for filling tortuous paths. UCRL-JC-127540 (preprint).*

*Primary Examiner*—Aileen Felton
(74) *Attorney, Agent, or Firm*—Ann M. Lee; John H. Lee

(57) ABSTRACT

Hollow RX-08HD cylindrical charges were loaded with boron and PTFE, in the form of low-bulk density powders or powders dispersed in a rigid foam matrix. Each charge was initiated by a Comp B booster at one end, producing a detonation wave propagating down the length of the cylinder, crushing the foam or bulk powder and collapsing the void spaces. The PdV work done in crushing the material heated it to high temperatures, expelling it in a high velocity fluid jet. In the case of boron particles supported in foam, framing camera photos, temperature measurements, and aluminum witness plates suggest that the boron was completely vaporized by the crush wave and that the boron vapor turbulently mixed with and burned in the surrounding air. In the case of PTFE powder, X-ray photoelectron spectroscopy of residues recovered from fragments of a granite target slab suggest that heating was sufficient to dissociate the PTFE to carbon vapor and molecular fluorine which reacted with the quartz and aluminum silicates in the granite to form aluminum oxide and mineral fluoride compounds.

30 Claims, 8 Drawing Sheets

EXPLOSIVELY DRIVEN LOW-DENSITY FOAMS AND POWDERS

RELATED APPLICATION

This invention is a continuation-in-part of copending U.S. patent application Ser. No. 10/427,612 filed Apr. 30, 2003 now abandoned (IL-11136) entitled "Explosively Driven Low-Density Foam and Powders" which is also a continuation-in-part of copending U.S. patent application Ser. No. 10/293,659" filed Nov. 12, 2002 now U.S Pat. No. 6,875,294 (IL-10945) entitled "Light Metal Explosives and Propellants". Additionally, this application claims the benefit of priority in U.S. patent application Ser. No. 10/293,659" filed Nov. 12, 2002 entitled "Light Metal Explosives and Propellants" and claims benefit of priority in U.S. patent application Ser. No. 10/427,612 filed Apr. 30, 2003 which are hereby incorporated by reference by the same inventors and assigned to the same assignee is related to this application and is hereby incorporated by reference.

The United States Government has rights in this invention pursuant to Contract No. W-7405-ENG-48 between the United States Department of Energy and the University of California for the operation of Lawrence Livermore National Laboratory.

BACKGROUND

Several proposed new types of high explosive devices involve burning boron, or other light metals. (See U.S. patent application Ser. No. 10/293,659) Magnesium and aluminum have low melting points about 920-930K, and are relatively easily ignited, whereas boron melts at 2350K, vaporizes at 4140K, and has a dry air ignition temperature of about 1950K. (See H. L. Besser and R. Strecker, "Overview of Boron Ducted Rocket Development During the Last Two Decades" in *Combustion of Boron-Based Solid Propellants and Solid Fuels*, edited by K. K. Kuo, and R. Pein, CRC Press, Boca Raton, 1993, which is hereby incorporated by reference.) Boron also has a high heat of vaporization, 480-kJ/mol, or 10.6 kcal/g. Explosive initiation of a boron burn will probably require either the presence of a catalyst or some means of heating the boron to very high temperatures. Shocking boron particles with a high explosive detonation wave will not produce temperatures high enough to cause melting because boron is a relatively incompressible brittle substance with a bulk modulus of about 2.6 Mb. Although temperatures attained within the reaction zone of a detonating high explosive are high, about 3000-4000K depending on the explosive, they are maintained only for short intervals, of the order of hundreds of nanoseconds.

SUMMARY OF THE INVENTION

An aspect of the invention includes a device comprising: a housing of plastic bonded explosive, the housing having a boron-in-foam core, wherein the boron-in-foam core comprises powdered boron particles dispersed in a rigid foam material.

Another aspect of the invention includes a device comprising: an inner housing of plastic bonded explosive, the housing having a boron-in-foam core, wherein the boron-in-foam core comprises powdered boron particles dispersed in a rigid foam material; a thin metal wafer; a detonator and booster plug assembly; and an outer housing to house the inner housing, the metal wafer, and the detonator and booster assembly.

A further aspect of the invention includes a device comprising: a housing of plastic bonded explosive, the housing filled with a powdered PTFE polymer having a bulk density ranging from 0.25 g/cm$^3$ to 1 g/cm$^3$.

Another aspect of the invention includes A method comprising: loading an explosive charge with low bulk density PTFE polymer; detonating the explosive charge; generating sufficient heat to dissociate the PTFE polymer; and dissociating the PTFE polymer to create a hot, high speed stream of molecular fluorine.

DETAILED DESCRIPTION

Boron in the form of either a low bulk density powder (bulk density less than 1 g/cc), or a low bulk density powder dispersed in rigid foam matrix, or polytetrafluoroethylene resin, herein after referred to as PTFE, in low bulk density powder form (bulk density less than 1 g/cc) are loaded into hollow high explosive charges to create explosive devices that generate high temperatures and expel high velocity fluid jets. Each charge is initiated by a high explosive booster at one end which produces a detonation wave propagated down the length of the charge, crushing the powder or foam matrix and collapsing the void spaces. The PdV work done in crushing the powders or foam matrices heats them to high temperatures and expels them in a high velocity fluid jet. For example, a boron burn can be explosively initiated by separating the boron from the high explosive, dispersing the boron particles in a low density foam and using explosive expansion PdV work on the foam to do the boron heating.

Separating the boron from the high explosive has advantages over simply mixing boron powders into the high explosive, because unless boron is in the form of extremely small particles well dispersed in the explosive, limits on the heating rate may prevent the boron particles from attaining high enough temperatures to begin reacting with the carbon dioxide, carbon monoxide, water, and nitrogen in the detonation products. Explosive initiation of boron oxidation may also be inhibited by shifts in chemical equilibrium produced by the 25-35 GPa pressure levels in detonation waves.

Separating the boron from the high explosive, dispersing the boron particles in a low-density foam and using explosive expansion PdV work on the foam to do the boron heating provides a means to reach sufficiently high temperatures. The volume change involved in crushing a foam permits a large amount of energy to be deposited in the foam, and the effect can be amplified within a cylindrical implosion configuration. High temperatures can be maintained over a relatively long time, at least compared with the situation of boron particles in expanding detonation product gases. Hot boron can be expelled from the center of the implosion as a high velocity jet of dense vapor or fluid. Turbulent mixing with the surrounding air should promote burning of the vaporized boron producing a directed effect.

Figure 1:
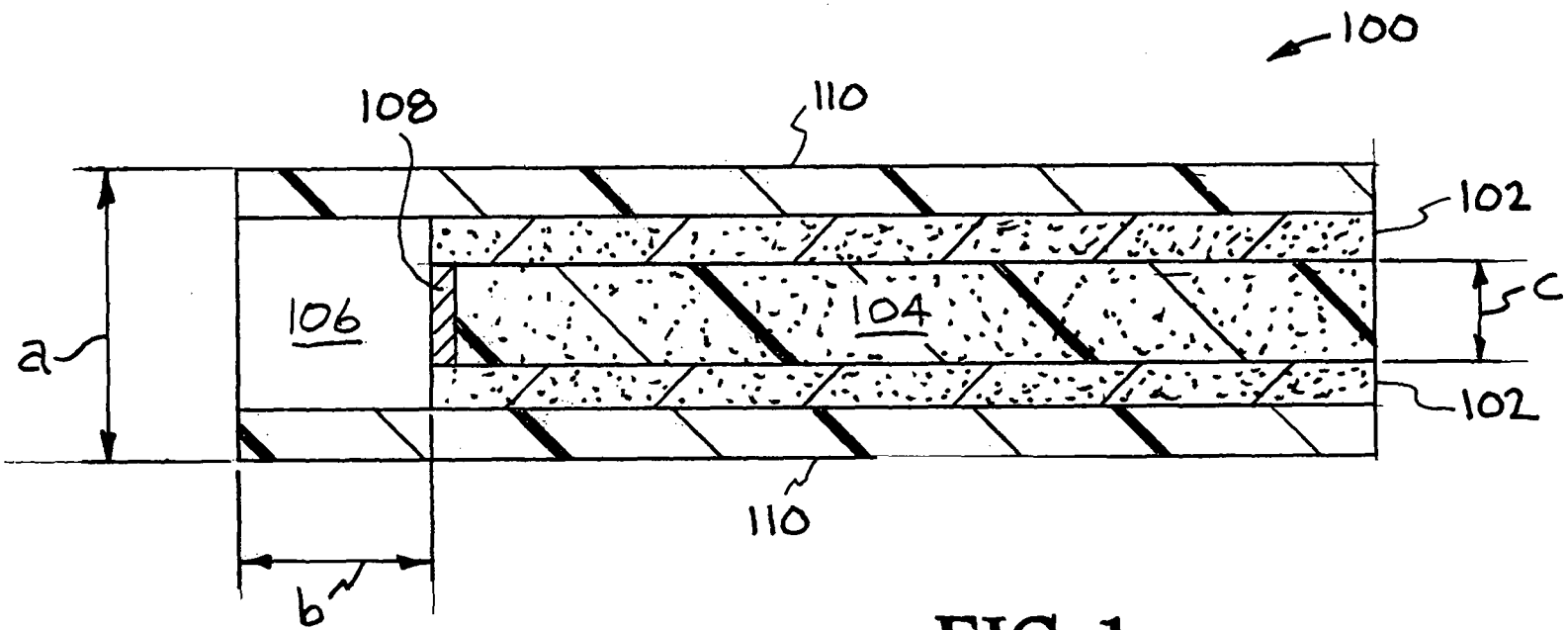
FIG. 1 is a diagram of an explosive device.

An explosive device incorporating these ideas is shown in FIG. 1. Referring to FIG. 1, the device 100 comprises a thick-walled (0.5 inch inner diameter to 1 inch outer diameter) hollow cylinder of plastic bonded explosive 102, filled with boron powder (not shown) dispersed in and supported by a rigid foam (not shown) to form a boron-in-foam core 104. One end of device 100 is fitted with a detonator and booster plug assembly 106 (comprising a detonator and a booster), separated from the boron-in-foam core by a thin (0.1 cm to 0.2 cm) metal wafer or disk 108. Copper is an efficient material for the disk. The purpose of the disk is to delay axial expansion of booster detonation products into the boron-in-foam core. The explosive cylinder can be enclosed in a plastic casing 110, but substitution of a thick-walled (0.2 cm to 0.4 cm) steel case will somewhat improve energy delivery to the boron-in-foam core. RX-08 HD, HMX crystals mixed with a curable resin paste binder, is of interest for this application because it can be extruded in hollow cylindrical form. RX-08 HD is an explosive formulation designed to allow the transfer of explosives through long tortuous paths or into fine 3-dimensional shapes. Bimodal mixtures of HMX crystals are used along with a lubricating fluid. The energetic liquid trimethylolethanetrinitrate (TMETN) is used as the lubricant to maximize explosive energy. TMETN is a liquid nitrate ester which requires stabilization with conventional free radical stabilizers such as 2-nitrodiphenylamine (2-NDPA), methylnitroanaline (MNA), or ethyl centralite (EC). Since the injection moldable explosives are designed to cure in place, a polyesterurethane binder based on a polymeric isocyanate of hexamethylene diisocyanate (N-100) and polycaprolactone polyols is dissolved in the TMETN. The solubility of the polymer precursors in TMETN also reduces the energetic liquid's sensitivity. The latent cure catalyst Dabco T-131 is used to minimize shrinkage associated with thermal expansion. The exact formulation is described herein under the heading "Experiments". A cylindrical shape enables the formation of a long continuous stream of reactive vapor. The boron-in-foam core can be fabricated from a mix of unexpanded and expanded polymeric micro-balloons and μm sized boron particles. The density of the foam can be controlled by varying the mass ratio of boron to unexpanded to expanded microballoons. Heating of the mixture in a cylindrical mold expands the unexpanded microspheres, producing a mechanically robust, rigid plastic part that can be included in the RX-08HD extrusion mold. The dimensions shown in FIG. 1, wherein a=2.54 cm, b=2.54-cm, and c=1.27 cm can be increased indefinitely, i.e., enlarging the component parts so as to keep them in approximately the same proportion relative to each other.

If a boron-in-foam core could be inserted into a close fitting HE part, then any high-energy plastic binder solid explosives that can be machined instead of extruded, such as TATB or HMX based plastic bonded explosives, can be used (e.g., machining two lengthwise half cylinders and then gluing them together around the foam core).

The boron-in-foam cores use powdered boron obtained from Aldrich. μ Solid boron has a density of approximately 2.34 g/cc, but because of the void spaces in bulk powder the average vibration or tap density of the 44 μm powder is about 1.0 g/cc. Smaller particle sizes down to 1 μm, with tap densities of 0.2 g/cc or less are available from different suppliers. The 44 μm size was used because it can be easily mixed with EXPANCEL® microspheres.

EXPANCEL® microspheres are small spherical plastic particles comprising a polymer shell (polyacrylonitrile and/or polymethacrylonitrile) encapsulating a hydrocarbon gas, i.e., iso-pentane. When the iso-pentane inside the shell is heated, it increases its pressure and the thermoplastic shell softens, resulting in a dramatic increase in the volume of the microspheres. When fully expanded, the volume of the microspheres increases more than 40 times.

The dramatic expansion when heated and the other unique properties of EXPANCEL® microspheres are due to a small amount of a hydrocarbon encapsulated by a gastight thermoplastic shell made of polyacrylonitrile and/or polymethacrylonitrile. When the microspheres are heated the thermoplastic shell softens and the hydrocarbon inside the shell increases its pressure. This results in a dramatic expansion of the spheres (typical diameter values: from 10 to 40 μm), with a corresponding dramatic decrease of the density (typical values: from 1000 to 30 g/liter).

The different EXPANCEL® microsphere grades vary according to: expansion factor, heat resistance, particle size, chemical and solvent resistance. There are grades of EXPANCEL® microspheres available with expansion temperatures in the range of 80-190° C. (176-374° F.). The temperature at which expansion starts as well as the temperature at which the maximum expansion and the lowest density is obtained depends to some degree on the heating rate. At temperatures above the temperature at which the highest expansion is obtained the microspheres gradually collapse. All EXPANCEL® grades are highly resilient. The expanded microspheres are easy to compress. When the pressure is reduced the microspheres regain their original volume. EXPANCEL® microspheres can be used in contact with many chemicals, including solvents, without negative effects on expansion or other properties.

There are two main types of EXPANCEL® microspheres, unexpanded and expanded. The unexpanded microspheres include: EXPANCEL® WU—wet unexpanded microspheres, EXPANCEL® DU—dry unexpanded microspheres, EXPANCEL® slurry—dispersion of unexpanded microspheres, EXPANCEL® MB—master batch of unexpanded microspheres in a matrix. The expanded microspheres include: EXPANCEL® WE—wet expanded microspheres and EXPANCEL® DE—dry expanded microspheres. Product specifications for EXPANCEL® WU, EXPANCEL® DU, EXPANCEL® WE, and EXPANCEL® DE are available as downloads at the web address, www.expancel.com.

In order to meet the requirements of new applications, the number of EXPANCEL® grades has been increasing steadily. Today, approximately 20 grades are available and new varieties are added every year. Newly developed grades of EXPANCEL® or other similar products that become available should be adaptable for use as a component in the boron-in-foam core.

Explosively driven foam crushing can be applied to achieve other objectives besides initiating boron burning in ambient surrounding air, such as creating a stream of vapor in a state to promote reaction with a target material. For example, fluorine, or a few relatively unstable fluorine compounds, are about the only substances that will react readily with granite. These substances are difficult to work with, whereas potential sources of fluorine, such as fluoropolymer resins, e.g. PTFE polymer (Teflon® by DuPont), are relatively inert, stable and safe to handle. Explosive crushing and compression of low-bulk density PTFE powder can heat the material enough to dissociate the carbon-fluorine polymer, producing a stream of hot carbon vapor, CF2 fragments, and possibly molecular fluorine which can react with relatively inert materials such as the quartz, and aluminum silicates present in granite. Any fluoropolymer resin powder with a low bulk density should be effective for this purpose.

A Priori Hydrodynamic Computations

Possible dynamics of the explosive devices disclosed herein were obtained from CALE hydrodynamic code simulations. (See, R. Tipton, "CALE Users Manual", Lawrence Livermore National Laboratory Report 961101 (1996), which is hereby incorporated by reference.) The code can compute flows using either Lagrangian or Eulerian coordinate frames or a combination of both and contains a wide range of equation of state forms, and has provision for strength of materials, yield, plastic flow, and fracture. High explosive burn is modeled using programmed lighting tables and a JWL expansion isentrope with coefficients derived from cylinder expansion experiments. The code can be run in an interactive mode and has an extensive set of commands that can be used to delete or add mesh lines, clear mesh tangles, monitor zone quantities, and do many other things that facilitate keeping an integration running efficiently.

An equation of state for the boron seeded foam mixture was derived from boron Hugoniot data (see *LASL Shock Hugoniot Data*, S. P. Marsh, Editor (University of California Press, Berkeley, Calif., 1980), which is hereby incorporated by reference.) and mechanical stress-strain crush curves obtained from foam samples. The pure microballoon foam itself can have average densities as low as about 0.013 g/cc, whereas the density of boron is about 2.34 g/cc. Therefore, for any fill density of interest, the mass of microballoon decomposition products mixed in with the hot boron left from explosively crushing the foam should be negligible in comparison with the boron mass. For example, the ratio of boron to plastic mass for an average boron seeded foam density of 0.24 g/cc is about 6:1. The pressure computed from the equation of state tracks the experimental foam crush curve pressure until the density reaches the density of pure boron, then follows the pressure calculated for pure boron. The pressure in pure boron was calculated from, $$p=A_0+A_1(\eta-1)+A_2(\eta-1)^2+A_3(\eta-1)^3+\Gamma e, \quad (1)$$

where e is internal energy, and Γ is a Güneisen gamma, specified by $$\Gamma=B_0+B_1(\eta-1)+B_2(\eta-1)_2. \quad (2)$$

The A, B coefficients and the crush curve values are specified in Tables I and II.

TABLE 1

CALE equation of state input parameters.

| Parameters | Boron |
|---|---|
| Ref. density | 2.338 |
| A0 | 0.0 |
| A1 | 3.74056 |
| A2 | −8.01658 |
| A3 | 10.6599 |
| B0 | 1.25 |
| B1 | 0.0 |
| B2 | 0.0 |
| Ex | 1.0 |

TABLE 2

Crush curves

| Boron-in-foam density (g/cc) | Boron-in-foam pressure (Mb) |
|---|---|
| 0.1 | 0.0 |
| 0.6 | 0.0001001 |
| 1.1 | 0.0001971 |
| 1.6 | 0.0002935 |
| 2.1 | 0.0004863 |
| 2.6 | 0.000863 |
| 3.1 | 0.0005827 |

Figure 2:
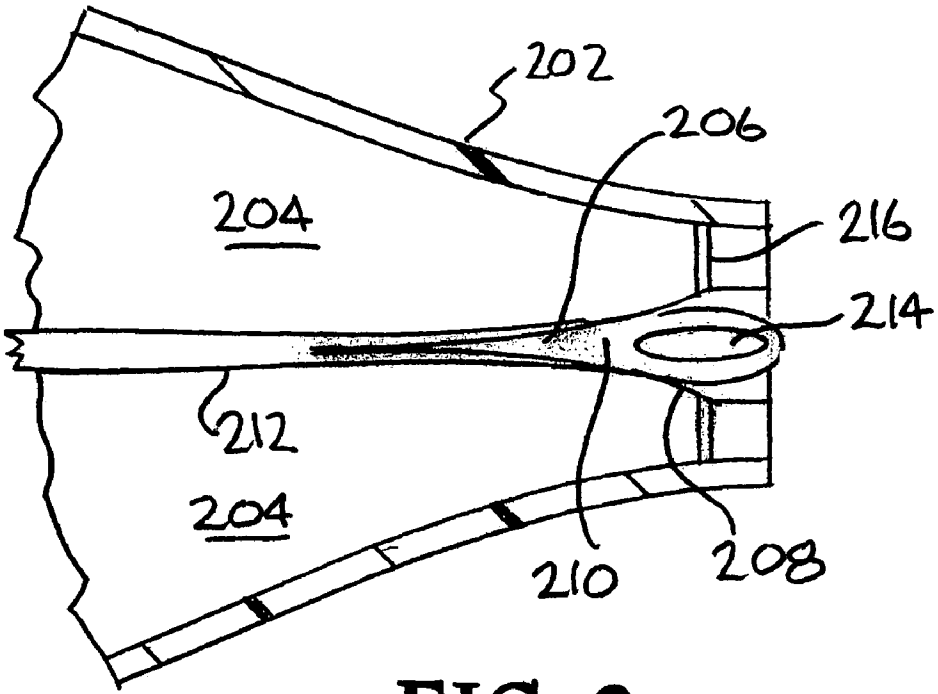
FIG. 2 is an illustration generated from a CALE calculation of the hydrodynamic motion during detonation of an explosive device.

Calculations of the device operation focused on a 2.54 cm diameter, 10 cm length 65 g RX-08HD charge intended for firing inside a 1 kg test tank, but there is nothing preventing larger diameters or much greater lengths, nor is there anything limiting the length to diameter ratio. The computer-modeled snapshot illustrated in FIG. 2 shows the configuration of the casing 202, detonation products 204 and crushed boron-in-foam core 206 approaching the end of the high explosive burn. After initiation at the center of the backside of the booster plug, a detonation front burns around the metal disk and down the hollow RX-08HD cylinder. The interface 208 between the RX-08HD and the boron-in-foam core has the shape of an imploding conical surface behind the detonation front, moving with the detonation velocity. Behind the front the detonation products expand laterally compressing and crushing the boron-in-foam core to a density of about 2 g/cc and heating the boron. The boron behind the conical pinch point 210, the slug flow 212, moves along the axis of the cylinder at velocities in the range of 2-4 km/s depending on the initial foam density. If the initial foam density is low enough, about 0.3 g/cc or less, a high velocity jet 214 forms in front of the pinch, with much of the same hydrodynamics as jet formation in a conventional conical shaped charge.

The jet produced when the foam density is low enough, moves faster than the detonation wave 216 so that, as the detonation wave travels down the high-explosive cylinder, the jet tip extends further and further ahead of the detonation wave. A bow shock bends back from the jet tip becoming nearly parallel to the inner wall of the high-explosive cylinder and eventually intersecting the conical implosion wave. The effect of the bow shock is to sweep aside the foam creating a hole in which the jet travels. Newly compressed and heated boron is continually being added at the base of the jet although the ratio of metal mass going into the jet remains very small compared with the mass passing into the slug flow. There is little if any stretching along the jet axis, and the jet velocity and density tend to be uniform. Letting the jet cut through the foam ahead apparently helps maintain uniformity of the jet, because computations using a foam fill with a small hole to allow free passage of the jet yield highly stretched non-uniform jets. The density in the jet approaches normal boron density, about 2 g/cc.

Penetration capability was taken into account for tank testing safety. Calculations were done for 6061-T6 aluminum because this metal has previously been used as a calibration tool for comparing conventional shaped charges. The calculated maximum penetration obtained from using 2.6 g of boron in an 10 cm length foam fill driven by 65 g RX-08HD with 2.54 cm outer diameter is about 15 cm, compared with about 25 cm for a conventional optimized tungsten-copper liner shaped charge driven by 23 g RDX. (See L. A. Glenn, J. B. Chase, J. Barker, and D. J. Leidel, "Experiments in Support of Pressure Enhanced Penetration with Shaped Charge Perforators" Lawrence Livermore National Laboratory Report UCRL-132950 (1999), which is hereby incorporated by reference.) RDX with a few percent binder is about as energetic as RX-08HD, which uses 75 wt % HMX with an active binder, but the boron jet penetrating capability is fairly limited with respect to the test device even though the jet velocity is high, given sufficiently low foam densities. This is because the foam density required to obtain a jet limits the ratio of mass in the jet to mass of HE (high explosive) to much lower values than in a conventional shaped charge. The low mass of the boron jet considerably reduces its penetrating capability relative to the amount of explosive used. These calculations assume that the boron remains in the solid state, because of the limitation on the available equation of state forms, but if the boron transforms to the gas phase then penetrating capability will be greatly reduced.

Boron temperatures obtained in the approximately axially uniform slug flow following the conical pinch point depend on the initial density and porosity of the boron-in-foam fill. Temperatures are highest on the axis of the stream and lowest approaching the outer diameter of the crushed foam. The hydrodynamic computations and associated equations of state use internal energy in place of temperature for the state variable, so specific heat tables were used to convert CALE internal energies to temperatures. A two-oscillator Einstein specific heat model was fitted to the JANAF specific heat tables for boron, then it was integrated with respect to temperature T to get an equation for the internal energy, $$e(T) = \frac{2.074}{e^{898.7/T} - 1} + \frac{25.88}{e^{11216./T} - 1}\,\text{kJ/g B.} \tag{3}$$

For each CALE output data point, Eq. (3) was set equal to the hydrodynamic internal energy and solved numerically for the corresponding temperature. (See NIST-JANAF Thermochemical Tables Fourth Edition, *Journal of Physical and Chemical Reference Data*, Monograph No. 9, Parts I and II, M. W. Chase, Jr., Editor (American Institute of Physics, Woodbury, N.Y., 1998), which is hereby incorporated by reference.)

Figure 3:
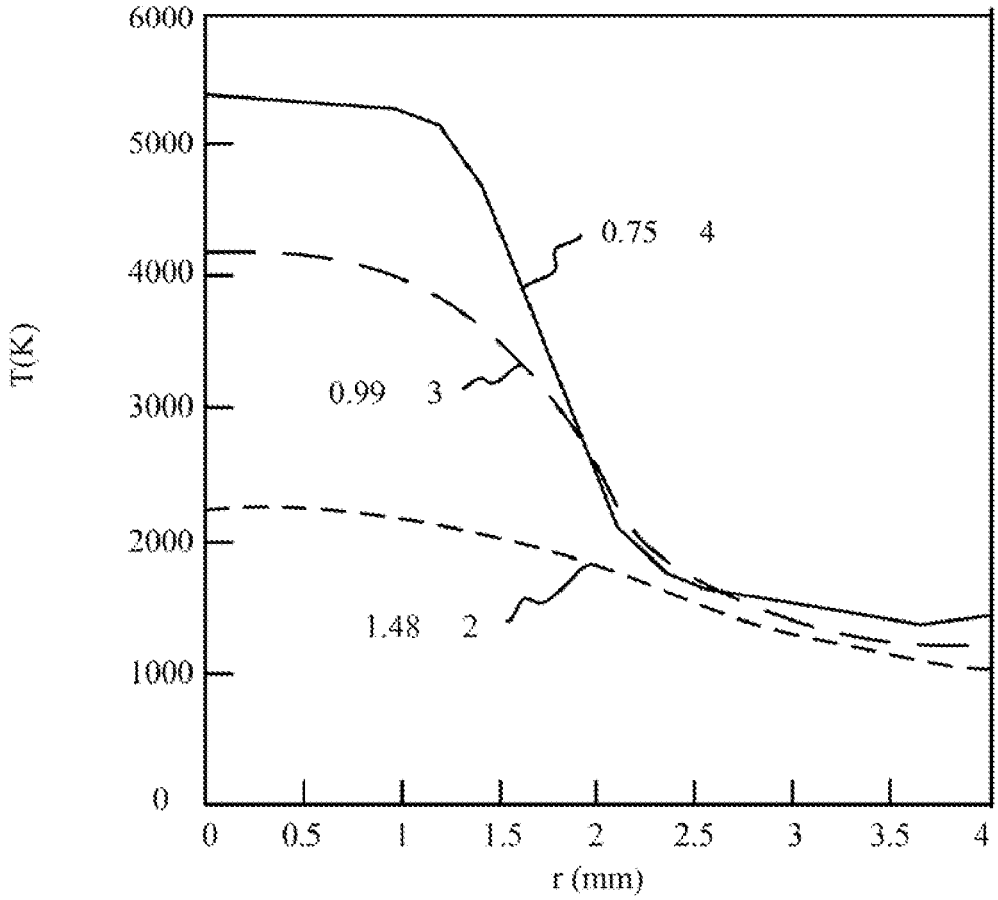
FIG. 3 shows calculated radial profiles of jet temperature versus initial foam density.

Examination of temperatures in the boron stream flowing behind the conical pinch point suggested that shock crushing of the foam could raise the boron temperature well above the metal's ignition point for burning in dry air. FIG. 3 shows radial cross section profiles of temperature for a test shot configuration computed for three different boron-in-foam densities, using RX-08HD for the explosive driver. The solid line depicts a foam density of 0.74 g/cc and an HE/boron mass ratio of 4. The dashed line depicts a foam density of 0.99 g/cc and an HE/boron mass ratio of 3. The dotted line depicts a foam density 1.48 g/cc and an HE/boron mass ratio of 2. A foam density of 1.0 g/cc is low enough to produce crush temperatures approaching the vaporization temperature. Assuming afterburning in the surrounding ambient air, or with an oxidizer target, boron ignition temperatures should be attainable with a enough boron mass to raise the total energy release, from boron burning and explosive detonation, well above what it would be if the mass of boron-in-foam were replaced by an equal mass of high explosive.

EXPERIMENTS

RX-08HD was prepared as follows. The energetic plasticizer trimethylolethanetrinitrate (TMETN) was purchased from Trojan Chemical Corporation or donated by NWC-1H Yorktown detachment. Trojan TMETN was stabilized with 2-nitrodiphenylamine (2-NDPA) while NWC-1H TMETN was stabilized with ethyl centralite (EC). The polyurethane binder is polymerized from polymeric hexamethylene diisocyanate (Desmondur N-100) manufactured by Mobay Corporation and polycaprolactone polyols (Tone 260 and Tone 6000) manufactured by Union Carbide Corporation. The latent cure catalyst, Dabco T-131, 1 manufactured by Air Products provided 4-6 h pot life and overnight cure to handling strength at ambient. A series of 74% solids formulations were prepared as indicated in Table 1 using various coarse and fine grades of HMX (coarse particles were >43μ LX04a and fine particles were class 5: LX-04 grade is a special grade of HMX made by Holston for LLNL's explosive LX-04. LX-04 grade HMX has a trimodal distribution of particles: about 12% is below 1 μm. About 30% is between 1 and 15 μm. The rest is between 15 μm and 200 μm. The average particle size is about 30 μm; Class 5 is a military specification for HMX. Approximately 98% of the HMX must pass through a 44 μm sieve. Class 5 HMX manufactured by Holston Army Ammunition Plant has a bimodal distribution of particles: about 30% is below 1 μm. The remaining particles are between 1 μm and 30 μm. The average particle size is about 2.5 μm.). These injection moldable explosives were formulated from a solution of TMETN and the Tone polyester polyols called RX-44-BJ combined with the bimodal distribution of HMX in a sigma-blade mixer. The TMETN and Tone polyols were dissolved at 60° C. for several hours with stirring then cooled to ambient. The T-131 mercaptotin catalyst was added and allowed to coordinate for 10-20 minutes. The HMX solids were added and mixed remotely under vacuum to constant viscosity. Prior to use, the injection moldable paste and N-100 isocyanate were mixed and allowed to cure.

TABLE 4

| Composition | % by weight | % by volume |
|---|---|---|
| HMX | 73.95 | 66.70 |
| TMETN | 19.33 | 22.59 |
| Tone 260 | 5.04 | 8.10 |
| Tone 6000 | 0.78 | 1.25 |
| Desmondur N-100 | 0.91 | 1.36 |
| Dabco T-131 | 0.007 | |
| Total | 100.00 | 100.00 |

Six 65 g RX-08HD charges were prepared by extruding the explosive paste into plastic molds. Three of the molds contained ½ inch diameter Teflon®-coated stainless steel rods that could be removed after the explosive had set up. The remaining three molds included ½ inch diameter boron particle in Expancel® foam cores. A polymethylmethacrylate casing for the explosive formed the outer wall of the mold. There was some concern that the peak pressures of about 90 psi attained during the extrusion process might collapse the foam cores, so the hope was that if this occurred, then the remaining boron-in-foam cores could be pushed into the holes left by removal of the steel rods. As it turned out, the foam had sufficient strength to avoid damage during the extrusion process, whereas it was impossible to push a foam core into one of the pre-formed hollow RX-08HD cylinders without damaging the foam because of the texture of the cured explosive.

The boron in Expancel® foam cores for all samples comprised 85 wt % 44 μm boron particles, embedded in a 15 wt % rigid foam mix of elements H. C, N, O composing the polyacrylonitrile, polymethacrylonitrile microspheres and the iso-pentane blowing agent. The bulk density of the 44 μm boron particles was about 1 g/cm$^3$. Supporting the particles in foam made it possible to reduce the average density below the threshold of 0.3 g/cm$^3$ that the CALE calculations suggested was necessary to attain the desired temperatures and velocities. Supporting the particles in foam also provided a more or less impervious temporary barrier to μm scale penetration of explosive detonation products into the spaces between the boron particles. The foam cores were fabricated at Sandia's Livermore Micro and Nano Materials Laboratory. (See L. Whinnery, S. Goods, and B. Even, "Expancel® Foams: Fabrication and Characterization of a New Reduced Density Cellular Material for Structural Applications", Sandia National Laboratories, Report SAND2000-8217, August 2000, which is hereby incorporated by reference.)

Boron Experiments

Five tests were conducted in the 1 kg North tank in the LLNL HEAF Facility. Two tests (test 1 and test 2) were made with the 44 μm boron, obtained from Aldrich, embedded in rigid Expancel® foam, to yield an average density of 0.24 g/cm$^3$. A third boron test (test 3) was done at an average density of 1.0 g/cm$^3$, using 44 μm boron powder without the rigid foam support. The fourth test (test 4) used powdered PTFE in place of boron and was fired against Sierra white granite. The fifth test (test 5) stacked the last two of the HE charges axially, with one cylinder loaded with 44 μm boron powder supported in foam and the second with 1 μm boron powder. The bulk density of the latter was about 0.2 g/cm$^3$. The amount of explosives used was 22 g Comp B+65 g RX-08HD in tests 1-4, and 22 g Comp B+130 g RX-08HD in test 5. Comp B is 60% RDX, 39% TNT and 1% wax. All of the HE charges were supported over the targets by a structural plate. Half inch thick Delrin® sheet material was used as the structural plate. A ½ inch hole was drilled through the sheet to allow a clear path between the end of the core load and the target. The upper ¼ inch was widened sufficiently to allow the casing around the HE to fit into it and maintain alignment of the charge axis with the center of the hole. In all shots the temperature-time evolution of the gaseous products contained by the tank was recorded by a sensor located behind a blast shield near the upper part of the tank wall.

Tests 1 & 2

Test 1 and test 2 were made with the 44 μm boron, obtained from Aldrich, embedded in rigid Expancel® foam, to yield an average density of 0.24 g/cm$^3$. The amount of explosives used was 22 g Comp B+65 g RX-08HD in both tests.

A Mod-6 framing camera with 400 ns frame interval and color film was used to record both of the 0.24 g/cm$^3$ boron-in-foam single shots (test 1 and test 2, respectively). In each of these shots the axis of the HE cylinders were aligned perpendicular to a stack of 1 inch thick 6061-T6 aluminum plates. Charge standoff from the top plate was 1 inch in test 1 and 5.5 inch in test 2. The CALE calculations with the metal equation of state had suggested the possibility of penetration to around 6 inches should the jet remain the solid state, so some care was taken to avoid damaging the tank, should this occur. The camera had no shutter, so there was also concern that light emission from the boron would last long enough to overwrite early time events. In fact, double exposures occurred in both shots, but the intensity and location of the light emitted at late times was such that the evolution of the boron jet could be clearly followed.

Test 3

Test 3 was performed with 13.32 g of 44 μm boron powder, bulk density 1.05 g/cm$^3$, substituted for the boron-in-foam core (an average density of 1 g/cm$^3$, using 44 μm boron powder without the rigid foam support). The amount of explosives used was 22 g Comp B+65 g RX-08HD. A much smaller, pitted crater, with little evidence of melting was produced at 1 inch standoff. A portion of the crater contained an embedded irregular black mass of what, under low magnification, appeared to be fused boron particles. The CALE calculations suggest that the maximum temperature produced was 4000K, not high enough to vaporize boron. The lack of evidence for vaporization is consistent with the fact that the energy required to vaporize the boron exceeded the energy available from detonation of the explosive.

Test 4

Test 4 used powdered PTFE with a bulk density of 0.77 g/cm$^3$ in place of boron and was fired against Sierra white granite. The amount of explosives used was 22 g Comp B+65 g RX-08HD.

Test 5

Test 5 stacked the last two of the HE charges axially, with one cylinder loaded with 44 μm boron powder supported in foam and the second with 1 μm boron powder. The bulk density of test 5 was about 0.2 g/cm$^3$. The amount of explosives used was 22 g Comp B+130 g RX-08HD.

Figure 4:
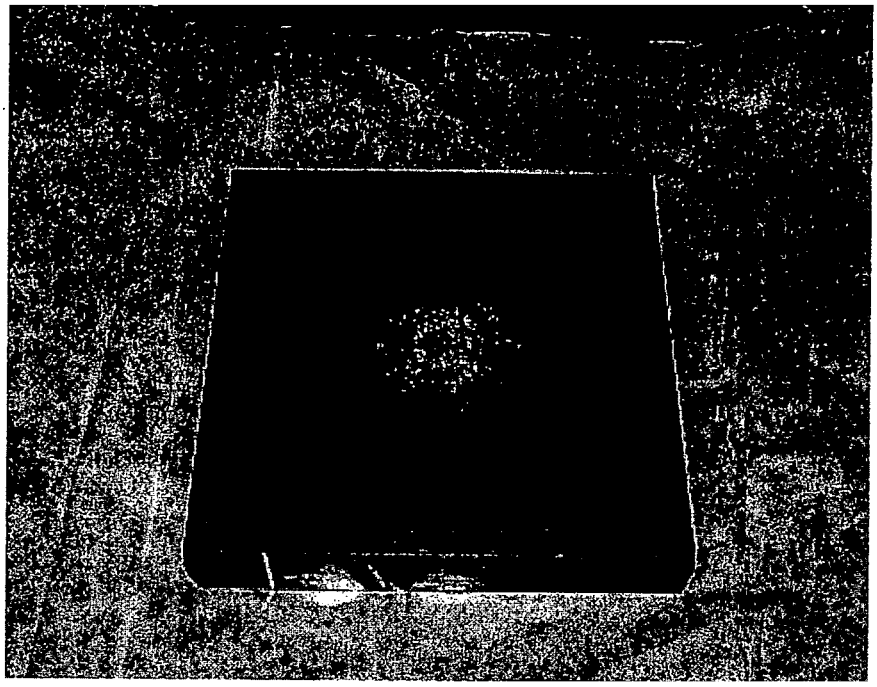
FIG. 4 is an aluminum witness plate, post-shot.
Figure 5:
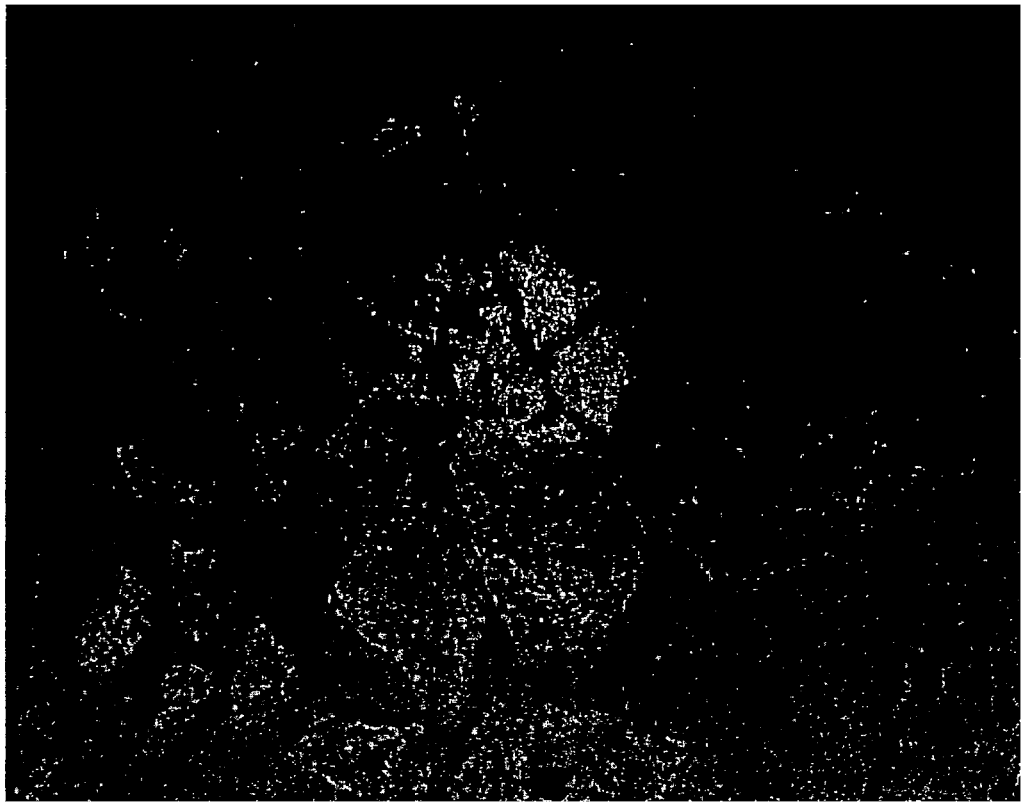
FIG. 5 is a Sierra white granite slab, post-shot.

FIGS. 4 and 5 show the evolution of the boron jet in the 5.5 inch standoff case (i.e., test 2). The velocity of the jet could be determined from the known camera framing interval and the number of frames required for the jet tip to cross the gap between the bottom of the Delrin® slab and the top of the aluminum witness plates. In both test 1 and test 2 the velocity was slightly in excess of 9.5 km/sec. The witness plate deflected the jet horizontally, with measured speed of about 5 km/sec in test 1. FIGS. 4 and 5 show motion consistent with that of a turbulent gas or fluid. There is no evidence of bright specks or streaks that might indicate the presence of solid particles in the flow. FIG. 4 shows the post-shot witness plate from test 1. It contains a crater about ¾ inch in diameter, depth about ¼ inch, having a shiny "new" aluminum surface and soft edges consistent with melting. There is no evidence of aggregates of black particles embedded in the aluminum. The back surface of the plate had a small bulge, less than ⅝ inch in height, aligned with the front surface crater. In test 2, there was no melt crater and no deformation of the aluminum plate, nor any evidence of boron particles embedded in the surface.

The boron jets had a blue-green color, corresponding to wavelength near 5000 A, or near 2.5 eV. The intensity of the radiation from the jets, brighter than the background reflected light from two flash lamps, approximately 10 inches distant, suggests considerable thermal energy at or above about 30,000K. A CALE derived calculation of the PdV work done on the 0.24 g/cm$^3$ boron-in-foam cores by the expanding detonation products, using boron specific heat data to convert internal energies to temperatures suggests temperatures about 50,000K. A third estimate of the temperature was derived from high speed turbulent flow heat transfer calculations, using the amount of aluminum melted in test 1, the camera derived velocities, and the amount of time available for melting to work back to estimate the average temperature of the jet. Some variables necessary for the calculations, such as the average density and viscosity of the jet gases, are not known although approximate order of magnitude estimates can be made. Calculations made for a range of possible values suggest jet temperatures of about 50,000K or higher.

The chemical energy released by detonating 65 g of RX-08HD is about 3.3 times the energy required to vaporize the 2.58 g of boron contained in a foam core, or on including the Comp B booster, about 4.4 times the boron vaporization energy. The time required to burn the explosive and produce a jet is about 15 μsec, so if the 44 μm boron particles did vaporize then the necessary energy had to be transferred within, at most, a few μsec. Diffusivities in a detonation environment, with densities of order 1 g/cm$^3$, are about 0.01 cm$^2$/s, so the distance heat and mass can be transported by thermal or atomic diffusion in 15 μsec is only about 6 μm, or approximately 1/7 the diameter of one of the boron particles. (See M. S. Shaw and J. D. Johnson, "Carbon clustering in detonations", *J. Appl. Phys.* 62, 2080-2085 (1987), which is hereby incorporated by reference.) Therefore it is unlikely that a diffusive transport mechanism could have delivered the required vaporization energy or allowed much chemical reaction within the jet formation time. However, with temperatures about 50,000K radiation could have transferred enough energy to vaporize the boron particles in a few μsec. Assuming the emissivity and absorptivity of a boron particle are both about 1, equating the energy to vaporize a particle of radius R to the black body radiation at temperature T absorbed over time τ yields, $$T = \left(\frac{\rho R \Delta H_v}{3\sigma\tau}\right)^{1/4} \tag{4}$$

where $\Delta H_v$ is the enthalpy of vaporization, ρ is the density of the particle, and τ is the Stefan-Boltzmann constant. Substituting density 2.34 g/cm$^3$, enthalpy of vaporization 480 kJ/mol, radius 22 μm, and 2 μsec for the time interval in Eq. (4) yields T about 51,000K. Vaporization of the boron particles within a time interval short relative to the jet formation time is consistent with the temperature estimates derived from the PdV work calculation and the rate of heat transfer to the aluminum witness plate.

TABLE 3

| | Peak tank temperatures | | | |
|---|---|---|---|---|
| HE mass | Boron mass (g) | PTFE mass (g) | Core bulk density (g/cc) | Temperature (F.) |
| 22 g Comp B 65 g RX-08HD | 0 | 9.75 | 0.77 | 118 |
| 22 g Comp B 65 g RX-08HD | 13.32 | 0 | 1.05 | 128 |
| g Comp B 65 g RX-08HD | 2.58 | 0 | 0.24 | 139 |
| 22 g Comp B 65 g RX-08HD | 2.58 | 0 | 0.24 | 153 |
| 22 g Comp B 130 g RX-08HD | 4.83 | 0 | 0.22 | 230 |

Tank temperature measurements, summarized in Table III, suggest that in the 0.24 g/cm$^3$ boron-in-foam core cases (i.e., test 1 and test 2), the boron reacted with the ambient air in the tank as it became entrained in the turbulent jet. Test 1 and test 2, boron-in-foam shots, produced peak tank temperatures of 153F and 139F, respectively. Test 4 was loaded with PTFE substituted for boron and yielded a peak temperature of 118F. In comparison, test 5 (one 22 g Comp B booster and two 65 g RX-08HD cylinders loaded with a 50:50 volume mix of 1 μm bulk density boron powder and 44 μm powder supported in foam) produced a peak temperature of 230F. Burning boron in air to $B_2O_3$ theoretically yields 44.5 kJ/g of boron, so 2.58 g of boron in foam, if completely burned should have added about 115 kJ to the about 410 kJ released by detonating 22 g of Comp B+65 g of RX-08HD. Assuming the peak tank temperatures are linear in energy release, and remembering that the detonation energy of the double shot was increased by a factor of about (22+65+65)/(22+65)=1.75 yields, $$\frac{dT_{peak}}{de_{det}} \approx \frac{230-(153+139)/2}{(1.75-1.0)410} \approx 0.275^\circ\ \text{F./kJ}. \tag{5}$$

This suggests that if the boron in the two 2.58 g boron-in-foam shots completely burned in the ambient tank air, then the peak tank temperatures should have increased by about 115 kJ times 0.275 F/kJ or about 30 F. The predicted boron burning temperature increase is consistent with the measured about 28 F increase relative to the PTFE experiment.

Boron particle burning in air is normally inhibited by a layer of liquid $B_2O_3$ forming on the surface of the particle. However, the oxide vaporizes at about 3000K, so one would expect that this barrier should not be present in the boron-in-foam experiments. The volume of air at 1 atmosphere pressure required to completely burn 2.58 g boron is about 22,700 cm$^3$. A rough estimate of the time required to entrain this volume of air can be obtained from volumes and times measured from the 5.5 inch standoff framing camera photographs from test 2. These data yield a volume expansion rate of about 53 cm$^3$/μsec, suggesting that about 400 μsec, at the very least, was required to complete burning of the boron in the ambient tank air.

PTFE Experiment

Low bulk density PTFE loaded explosive charges were tested in an attempt to create a hot high-speed stream of fluorine. Commercial PTFE powders are available with bulk densities ranging from about 0.25 g/cm$^3$ to about 0.9 g/cm$^3$ depending on the particle size and structure. A Dupont powder with a measured bulk density of 0.77 g/cm$^3$ was used for test 4 described briefly above. That density was expected to have been low enough to generate temperatures exceeding 5000K, sufficient to dissociate the $C_2F_4$ polymer having a chemical formula equal to recurring tetrafluoroethylene monomer units, i.e., $(CF_2—CF_2)_n$. Ab initio quantum mechanical calculations suggest the C—F bond strength is about that of the C═C bond, of the order of 80 kcal/mol, or about 3.5 eV. However, the actual temperature required for bond breaking can be much less than this because of local atomic scale energy fluctuations.

The witness plate for the PTFE shot was a 20 lb 3 inch thick slab of. Sierra white granite. Excluding the carbon component from sample contamination by soot, the atomic percent composition of a sample, as determined by X-ray photoelectron spectroscopy was about 67.6% oxygen, 20.6% silicon, 7.3% aluminum, 3.5% potassium, and 1.0% calcium. Viewing samples at low-power magnification revealed small quartz crystals embedded in a light gray cement, probably a form of aluminum silicate, with some dark inclusions. The slab had no obvious fractures or cracks and was placed approximately horizontal, with about 1 inch standoff from one of the hollow RX-08HD cylinders loaded with 9.75 g of PTFE powder. As shown in FIG. 5, the shot fractured the granite along radial lines extending from the jet impact point, leaving an eroded center region coated with a white material extending to a radius of about 1 inch.

Many scenarios can be constructed for dissociated PTFE reactions with granite. Two exothermic reactions of interest, PTFE with quartz and PTFE with aluminum silicate are, $$SiO_2+C_2F_4 \rightarrow SiF_4+2CO(0.398\ \text{kcal/g})\ 2Al_2SiO_5+5C_2F_4 \rightarrow 4AlF_3+2SiF_4+10CO(0.908\text{kcal/g})' \tag{6}$$

where the net energy released is per gram of $C_2F_4$. Except for aluminum fluoride, the products are gases. Assuming all of the PTFE reacted, about 6 g of granite should have been consumed in the experiment.

Samples of the PTFE powder, the granite, and the white material formed at the jet impact point were subjected to x-ray photoelectron spectroscopy (XPS) analysis. XPS involves the energy analysis of photoemitted electrons from a sample with energies characteristic of the target elemental composition. Small changes in the binding energy of the inner electrons of an element are produced when the atoms are chemically bonded to atoms of other elements, so that when comparing XPS lines from the same element in different chemical environments, shifts in the locations of the energy peaks are observed. The magnitude of the shifts are determined by the type and strength of the bonds. Identification of the chemical environment of an atom can be accomplished by comparing the binding energies for the same atom in various reference compounds.

The XPS data was collected using a Quantum 2000 scanning XPS system with a focused monochromatic Al Ka x-ray 1486.7 eV source for excitation. A 20 μm diameter x-ray beam was used for the analysis. The x-ray beam was incident normal to the sample and the detector was at 45° away from the normal. The instrument has a 16-element multichannel detection system. The pass energy was 23.5 eV giving an overall energy resolution of 0.3 eV. The collected data were referenced to an energy scale with binding energies for Cu 2p3/2 at 932.72±0.05 eV and Au 4f7/2 at 84.01±0.05 eV, and to the C 1s photoelectron line arising from adventitious carbon at 284.6 eV. Low energy electrons and argon ions were used for specimen neutralization.

Figure 6:
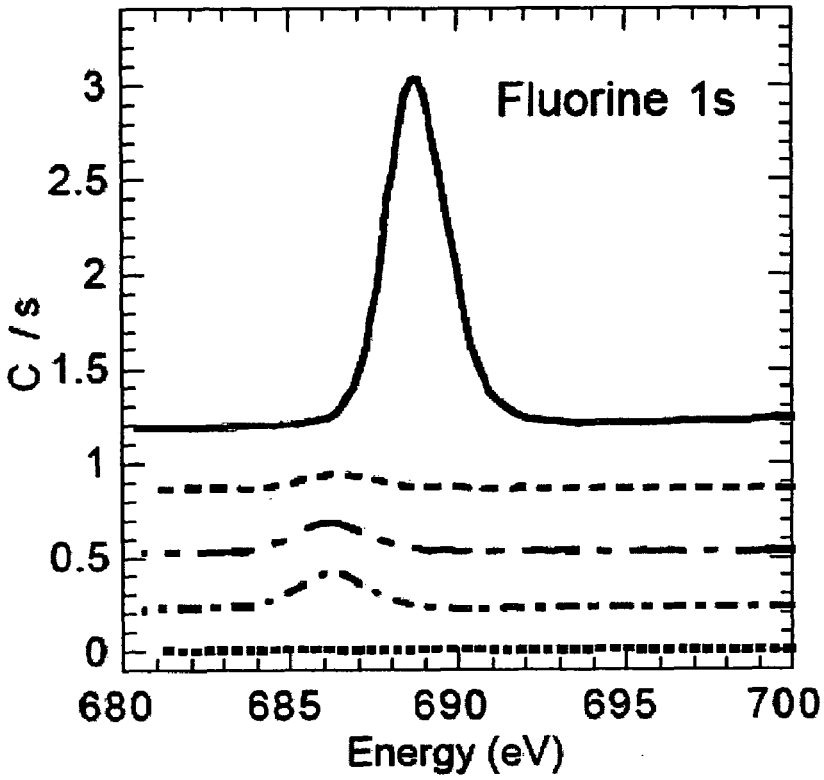
FIG. 6 the fluorine XPS energy spectra of fluorine.
Figure 7:
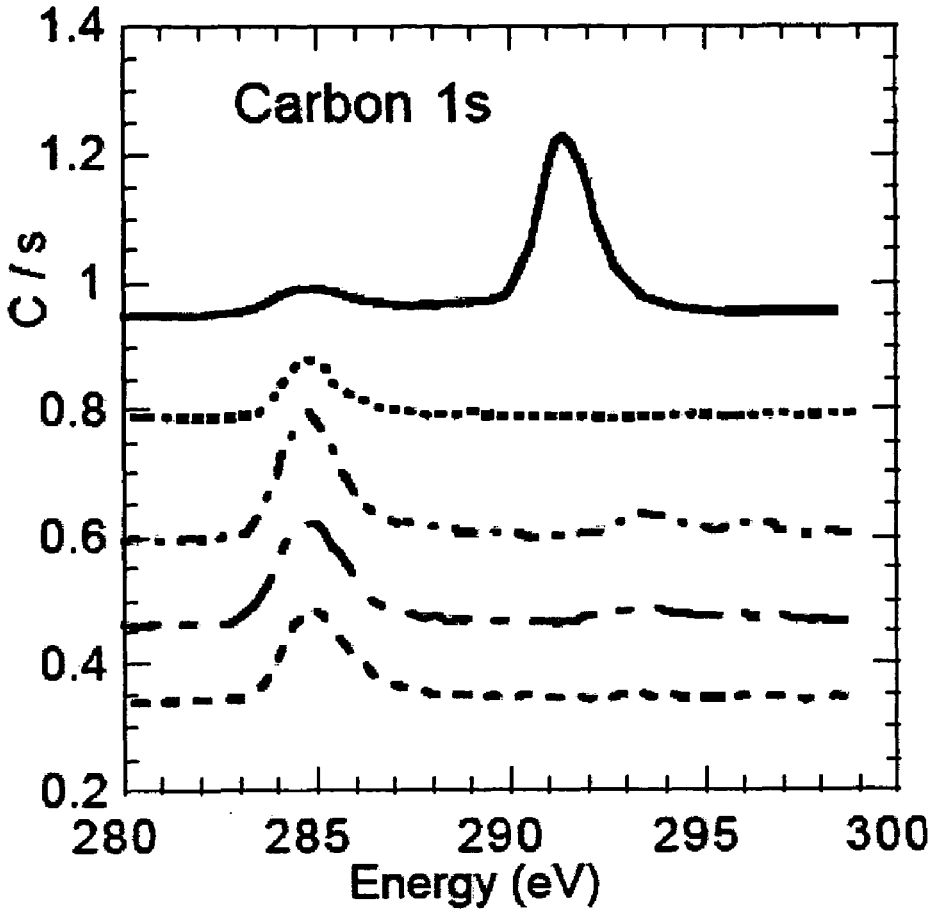
FIG. 7 shows the XPS energy spectra of carbon.

FIGS. 6 and 7 show the XPS energy spectra obtained for fluorine and carbon. The top and bottom lines in the figures show the spectra obtained from samples of the PTFE powder and the Sierra granite, respectively. The middle three lines show the spectra for three samples of the white material formed at the impact point. FIG. 6 shows there is fluorine in the three granite impact material samples, but none in the granite standard. The fluorine is peaks in the three impact samples are shifted down in energy from the PTFE peak by about 3 eV to 686 EV, which is consistent with fluoride ions at the surface of alumina. (See L. M. Rodriguez, J. Alcaraz, M. Hernandez, Y. Ben Taarit, and M. Vrinat, "Alkylation of benzene with propylene catalyzed by fluorined alumina" *Appl. Catalysis A: General,* 169 15-27 (1998), which is hereby incorporated by reference.) FIG. 7 shows that the PTFE sample has a large peak at about 291.5 eV which is not present in the three granite impact samples or the granite standard, indicating that carbon-fluorine bonds are not present in the white impact material, ruling out the possibility that some of the PTFE powder survived the detonation and sprayed out on the surface of the granite. The PTFE spectrum in FIG. 7 has a weak is peak at about 285 eV, corresponding to the polymer's carbon-carbon bonds. This peak is much stronger in the three impact material samples and in the granite standard, because all of the granite pieces were contaminated with soot from the RX-08HD and the Comp B.

Figure 8:
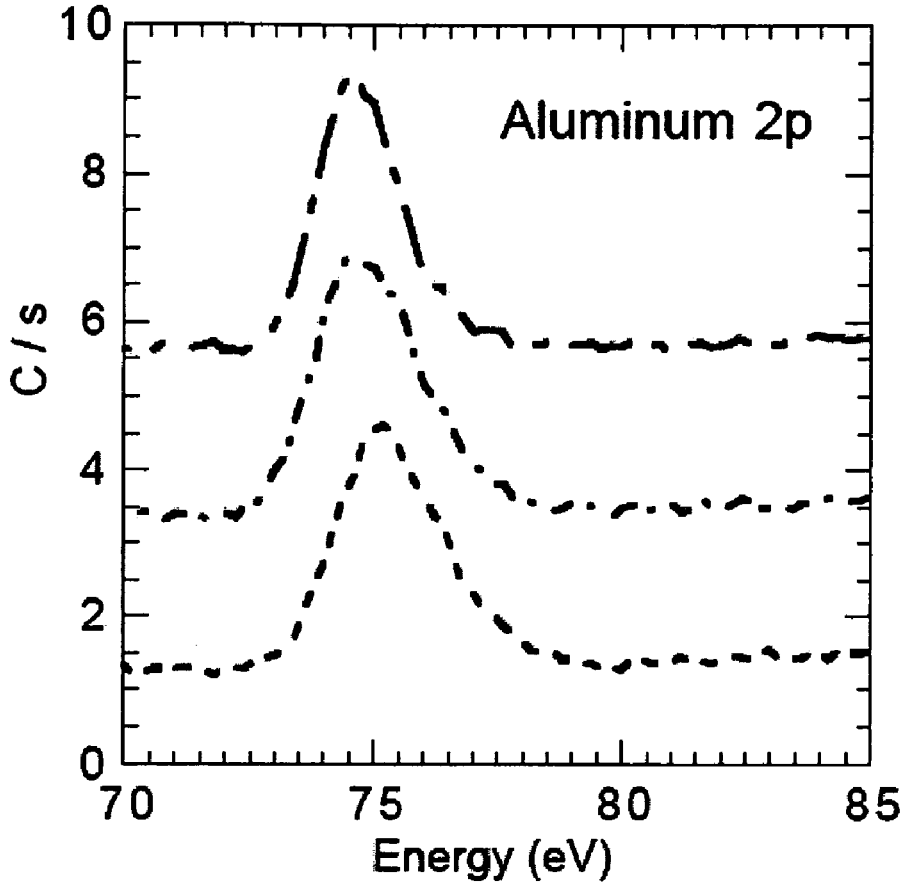
FIG. 8 shows the alumina XPS energy spectra obtained from three impact material samples.

FIG. 8 shows the aluminum XPS energy spectra obtained from the three impact material samples. The location of the 2p peak at about 74.5 eV is consistent with aluminum in $Al_2O_3$, but the wings are slightly skewed toward higher energies. In a fluorine environment the 2p peak shifts toward 76.5 eV, so the shifting of the wings toward higher energies is consistent with the 3-10% atomic fluorine levels found in the samples. The location and skewing of the Al 2p peak and the down shift of the F 1s peak to about 686 eV are consistent with the presence of aluminum oxide and small amounts of fluorides.

SUMMARY

The combination of the framing camera photographs showing a blue-green turbulent high speed gas-phase jet, the melting of the aluminum witness plate, and the lack of evidence for embedded boron particles all suggest that explosive crushing of the 0.24 g/cm$^3$ boron-in-foam cores vaporized the boron and that it burned in the ambient air within the tank. Theoretical calculations suggest the temperature reached during crushing was well above 10,000 K, high enough to radiatively heat the 44 μm boron particles above the vaporization temperature, about 4140K, within a few μsec. The crude calorimeter data that were obtained from the peak tank gas temperature readings are consistent with boron burning increasing the total energy release by about 30%. This is about the energy release derived from thermochemical calculations assuming the boron burned in the tank air to $B_2O_3$.

Even though the mass of boron contained in the 0.24 g/cm$^3$ foam core experiments was small in comparison with the mass of explosive, 2.58 g of B compared to 22 g Comp B+65 g RX-08HD, the net effect was to raise the energy output per unit mass above what it would have been if the 2.58 g B had been replaced by and additional 2.58 g RX-08HD. The experiments yielded an additional about 30% energy increase compared with about 3% had the boron mass been replaced by additional HE. If the energy release comparison is made on a per unit volume basis, then the difference is much less: about 30% versus about 19% had the foam core been replaced by RX-08HD. From the rate at which the volume of the turbulent jet was expanding, as calculated from the framing camera photographs, the jet should have entrained enough air to have completely burned the boron by about 400 μsec. Approximately then, ⅔ of the energy was released within the first about 15 μsec it took to detonate the high explosive, and the remaining ⅓ was produced by burning the boron in tank air during the following about 400 μsec.

The x-ray photoelectron spectroscopy analysis of impact samples from the PTFE powder experiment show that explosive crush heating dissociated the polymer freeing hot fluorine that reacted with the granite target forming mineral fluorides. Thermochemical calculations suggest the net energy released by reaction with the granite to form $SiF_4$, CO, $CO_2$ or other gases as well as the solid mineral fluorides was likely small, less than a few grams of HE equivalent energy. The radial fracturing of the granite slab was consistent with a surface stagnation pressure pulse delivered on bringing the jet to a stop, augmented by thermal shock and the chemical reactions at the granite surface.

All numbers expressing quantities of ingredients, constituents, reaction conditions, and so forth used in the specification and claims are to be understood as being modified in all instances by the term "about". Notwithstanding that the numerical ranges and parameters setting forth the broad scope of the subject matter presented herein are approximations, the numerical values set forth in the specific examples are reported as precisely as possible. Any numerical value, however, inherently contain certain errors necessarily resulting from the standard deviation found in their respective testing measurements.

While various materials, parameters, operational sequences, etc. have been described to exemplify and teach the principles of this invention, such are not intended to be limited. Modifications and changes may become apparent to those skilled in the art; and it is intended that the invention be limited only by the scope of the appended claims.

The invention claimed is:

1. A device comprising:

a housing of a plastic bonded explosive formulation;

a boron-in-foam core in the housing, wherein said boron-in-foam core comprises powdered boron particles dispersed in a rigid foam material, wherein the housing and boron-in-foam core are physically configured to create a high velocity fluid jet upon ignition of the housing, the jet moving in a direction away from a location of the ignition.

2. The device recited in claim 1, wherein said plastic bonded explosive formulation is RX-08HD.

3. The device recited in claim 1, wherein the explosive component in said plastic bonded explosive formulation is TATB or HMX.

4. The device recited in claim 1, wherein said boron-in-foam core has a bulk density of 0.1 g/cc to 1.0 g/cc.

5. The device recited in claim 1, wherein a longitudinal axis is defined between opposite ends of the core, further comprising a booster, the booster creating a detonation wave alone the longitudinal axis of the core sufficient to crush the core.

6. The device recited in claim 1, wherein said boron-in-foam core comprises 85-95% boron particles embedded in 5-15% by weight of rigid foam material.

7. The device recited in claim 1, wherein said boron particles are 1-50 μm in diameter.

8. The device recited in claim 1, wherein said rigid foam material comprises a mixture of polyacrylonitrile microsheres, polymethacrylonitrile microspheres and an iso-pentane blowing agent.

9. The device recited in claim 1, wherein said boron particles are 1-50 μm in diameter.

10. The device recited in claim 1, wherein said rigid foam material comprises polyacrylonitrile microspheres and an iso-pentane blowing agent.

11. The device recited in claim 1, wherein said rigid foam material comprises polymethacrylonitrile microspheres and an iso-pentane blowing agent.

12. A device comprising:

an inner housing of a plastic bonded explosive formulations;

a boron-in-foam core in the inner housing, wherein said boron-in-foam core comprises powdered boron particles dispersed in a rigid foam material;

a detonator and booster plug assembly;

a thin metal wafer positioned between the detonator and booster plug assembly and the boron-in-foam core, the wafer separating the detonator and booster plug assembly from the boron in foam core; and an outer housing to house said inner housing, said metal wafer, and said detonator and booster plug assembly, wherein the housing and boron-in-foam core are physically configured to create a high velocity fluid jet upon ignition of the housing, the jet moving in a direction away from a location of the ignition.

13. The device recited in claim 12, wherein said thin metal wafer is a copper disk having a thickness between 0.1-0.2 cm.

14. The device recited in claim 12, wherein said booster plug comprises Composition B (60% RDX, 39% TNT, and 1% wax).

15. The device recited in claim 12, wherein said outer housing comprises a plastic material.

16. The device recited in claim 12, wherein said outer housing comprises a metal or metal alloy.

17. The device recited in claim 16; wherein said metal alloy is steel.

18. The device recited in claim 12, wherein said plastic bonded explosive formulation is RX-08HD.

19. The device recited in claim 12, wherein the explosive component in said plastic bonded explosive formulation is TATB or HMX.

20. The device recited in claim 12, wherein said boron-in-foam core has a bulk density of 0.1 g/cc to 1 g/cc.

21. The device recited in claim 12, wherein said boron-in-foam core has a bulk density of 0.2-0.3 g/cc.

22. The device recited in claim 12, wherein said boron-in-foam core comprises 85-95% boron particles embedded in 5-15% by weight of rigid foam material.

23. The device recited in claim 12, wherein said boron particles are 1-50 μm in diameter.

24. The device recited in claim 12, wherein said rigid foam material comprises a mixture of polyacrylonitrile microsheres, polymethacrylonitrile microspheres and an iso-pentane blowing agent.

25. The device recited in claim 12, wherein said boron particles are 1-50 μm in diameter.

26. The device recited in claim 12, wherein said rigid foam material comprises polyacrylonitrile microspheres and an iso-pentane blowing agent.

27. A device comprising:

an inner housing of a plastic bonded explosive formulation, said inner housing having a boron-in-foam core, wherein said boron-in-foam core comprises powdered boron particles dispersed in a rigid foam material, wherein said explosive component in said plastic bonded explosive formulation comprises TATB;

an outer housing to house said inner housing;

a detonator and booster plug assembly for initiating the inner housing; and a plate positioned between the detonator and booster plug assembly and the boron-in-foam core, the plate separating the detonator and booster plug assembly from the boron in foam core.

28. A device comprising:

an inner housing of a plastic bonded explosive formulation, said inner housing having a boron-in-foam core, wherein said boron-in-foam core comprises powdered boron particles dispersed in a rigid foam material, and an outer housing to house said inner housing, said outer housing comprising at least one of a metal, a metal alloy, and plastic, wherein said inner housing is cylindrical and does not completely enclose opposite ends of the boron-in-foam core, wherein a longitudinal axis is defined between the opposite ends of the boron-in-foam core, wherein an outer diameter of the core is about constant along the axis thereof, wherein the housing and boron-in-foam core are physically configured to create a high velocity fluid jet upon ignition of the housing the jet moving in a direction away from a location of the ignition.

29. The device recited in claim 5, wherein the detonation wave produces a pressure level of 25-35 GPa.

30. The device recited in claim 1, wherein the plastic bonded explosive formulation is immediately adjacent the boron-in-foam core.

* * * * *